United States Patent [19]

Brunosson et al.

[11] 4,284,393

[45] Aug. 18, 1981

[54] POWDER MANUFACTURING APPARATUS

[75] Inventors: Gunnar Brunosson; Hans-Gunnar Larsson; Erik Westman, all of Vesteras, Sweden

[73] Assignee: ASEA Aktiebolag, Vesteras, Sweden

[21] Appl. No.: 150,931

[22] Filed: May 19, 1980

[30] Foreign Application Priority Data

May 31, 1979 [SE] Sweden ..... 7904750

[51] Int. Cl.[3] ..... B22F 9/00

[52] U.S. Cl. ..... 425/7

[58] Field of Search ..... 425/7; 264/12

[56] References Cited

U.S. PATENT DOCUMENTS

| | | | |
|---|---|---|---|
| 2,630,623 | 3/1953 | Chisholm et al. | 264/12 |
| 3,340,566 | 9/1967 | Woosley et al. | 425/7 |

*Primary Examiner*—Donald E. Czaja
*Assistant Examiner*—James R. Hall
*Attorney, Agent, or Firm*—Watson, Cole, Grindle & Watson

[57] ABSTRACT

Apparatus for manufacturing powder, especially metallic powder, by a melt atomization process, comprises a closed container in which a jet of gas is directed transversely into a stream of the melt and breaks it down into droplets which rapidly solidify and are thrown in a parabolic trajectory to the lower part of the container. In the lower part of the container there is an inclined bottom or a shaking table on which the powder flows to an outlet opening. Means are provided for withdrawing gas from the container, cooling it and re-introducing it into the lower part of the container where it is forced by guide means to flow in contact with the powder flowing to the outlet opening. The flow direction of this re-introduced gas is substantially opposite to the direction of flow of the powder to the outlet opening, so that it has an efficient cooling effect on the powder.

7 Claims, 2 Drawing Figures

POWDER MANUFACTURING APPARATUS

TECHNICAL FIELD

This invention relates to apparatus for manufacturing powder by a melt atomization process, said apparatus being of the kind comprising a container, means for forming a stream of the melt in said container, and means for directing a jet of gas transversely into the melt stream in order to atomize the melt stream into droplets which solidify in said container to form powder which falls to the lower part of the container. The apparatus may be used for all kinds of material but is primarily intended for manufacturing metallic powders having high contents of alloying materials, for example high-speed steel. In this case, the fine droplets formed solidify rapidly into a powder so that a fine-grained structure is obtained after solidification.

BACKGROUND ART

An apparatus of the kind referred to has been proposed, in which gas is withdrawn from the container and cooled and then directly re-circulated in the container for cooling the powder formed. In this known apparatus, the powder collected in the lower part of the container can have such a high temperature that, upon contact with air, it adsorbs such an amount of harmful gases that the quality of the powder may become deteriorated to an unacceptable extent. This involves complications when withdrawing the powder from the container, which either must be performed in an inert atmosphere, or the powder must be allowed to cool before it is withdrawn from the container. However, a compact mass of powder cools slowly and is difficult to cool.

DISCLOSURE OF INVENTION

According to the invention, apparatus for manufacturing powder by a melt atomizing process comprises a container, means for forming a stream of the melt in said container, means for directing a jet of gas transversely into the melt stream in order to atomize the melt stream into droplets which solidify in said container to form powder which falls onto a powder-receiving and transporting means in a lower part of said container for transporting the powder to an outlet for powder from the container, means for withdrawing gas from said container, means for cooling at least a part of the withdrawn gas, means for re-introducing at least part of the cooled gas into said lower part of the container, and guide means for forcing said re-introduced gas to flow in contact with the powder on said powder-receiving and transporting mens in a direction substantially opposite to the direction of flow of the powder as it is transported to said outlet by said powder-receiving and transporting means.

The powder-receiving and transporting means of the apparatus may consist simply of an inclined bottom of the container onto which the powder falls and then slides by gravity to said outlet. The bottom may be shaped as a channel to direct the powder to the outlet, and the bottom may be provided with openings or nozzles for the injection of gas to fluidize the powder, which not only has a cooling effect on the powder but also facilitates its movement towards said outlet.

Alternatively, said powder-receiving and transporting means may consist of a shaking table which, by its shaking movements, causes transportation of the powder to said outlet. This table may be channel shaped in order to direct the powder to said outlet. A shaking table of the kind which throws the powder obliquely upwards, thus displacing the powder stepwise towards said outlet, is most suitable. Because the powder is thrown up into the flow of re-introduced gas, a very efficient cooling is achieved.

The guide means for forcing said re-introduced gas to flow in contact with the powder may be formed by a wall of the container disposed above and substantially parallel to the powder-receiving surface of said powder-receiving and transporting means.

BRIEF DESCRIPTION OF DRAWING

The invention will now be described, by way of example, with reference to the accompanying drawing, in which.

DESCKIPTION OF PREFERRED EMBODIMENTS

Figure 1:
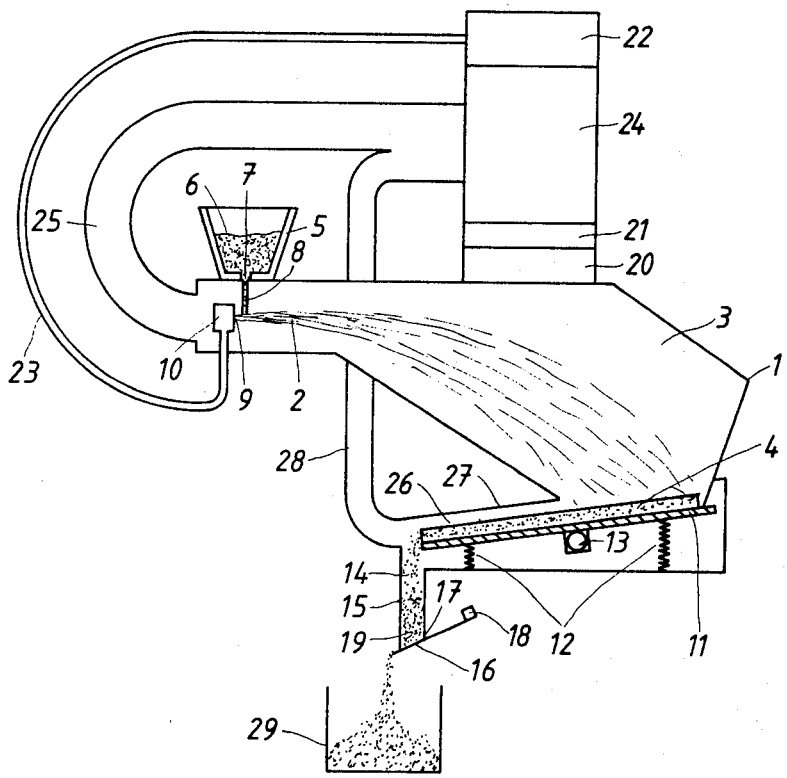
FIG. 1 is a schematic sectional view of a first embodiment of apparatus in accordance with the invention.

The apparatus shown in FIG. 1 comprises a container 1 with an atomizing space 2 and a collecting chamber 3 for powder 4 produced by atomization of a melt 6 contained in a casting box 5 arranged above the space 2. The melt 6, which for example may be a high-speed steel melt, runs through an outlet opening 7 in the bottom of the box 5 and falls as a stream 8 into a gas jet 9 issuing in a substantially horizontal direction from a nozzle 10. The gas jet 9 atomizes the melt stream 8 in the space 2, and the droplets of melt that are formed solidify in the collecting chamber 3 to produce the powder 4. The container 1 suitably has a shape similar to the trajectory of the powder in the container.

In the lower part of the collecting chamber 3 there is a shaking table 11 of channel-section which rests on resilient supports 12 and is activated by a drive means 13. The powder 4 which falls onto the shaking table 11 is moved towards an outlet opening 14 at the bottom of the container 1. The outlet opening 14 is in the form of a tube 15 with a clack valve 16 which is pivotally journalled around a substantially horizontal shaft 17 and provided with a counterweight 18. The valve 16 opens when the column 19 of powder in the tube 15 has reached a certain height, such that the weight of the powder column overcomees the closing moment exerted by the counterweight 18. The powder column 19 thus serves as a gas lock preventing gas from flowing out of, and air from flowing into, the chamber 3. The powder falling from the tube 15 is collected in a container 29.

Gas is withdrawn from the collecting chamber 3 through a cleaner 20 and a cooler 21, both mounted on the container 1. Part of the withdrawn gas is compressed in a compressor 22 and is conducted via a conduit 23 to the nozzle 10. The remainder of the cooled gas is returned to the container 1 by means of a fan 24, partly to the atomizing space 2 via a conduit 25 and partly via a conduit 28 to the lower part of the collecting chamber 3 near to the outlet opening 14. The cooled gas issuing from the conduit 28 is forced to pass through a gap 26 between a wall 27 of the container 1 and the shaking table 11 and thus cools the powder 4 flowing in the opposite direction on the table 11. An efficient cooling of the powder 4 is obtained in this way, particularly when using a shaking table of the kind which throws the powder up into the stream of cooling gas. For example, a cooling of the powder down to a temperature of 50° C. may be achieved, at which temperature the powder may be handled in air without any major inconvenience.

Figure 2:
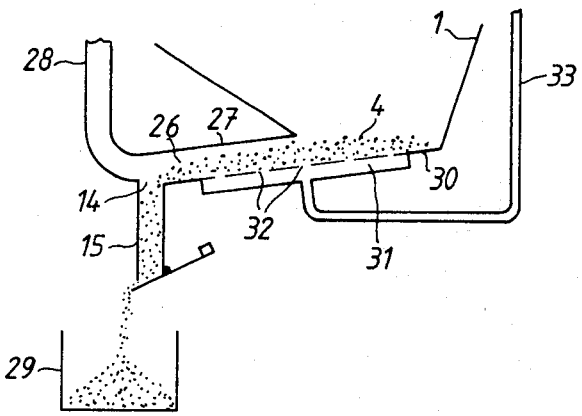
FIG. 2 is a schematic sectional view of a modified part of the apparatus of FIG. 1.

FIG. 2 shows part of a modified embodiment of the apparatus of FIG. 1. The difference between the apparatus of FIG. 2 and that of FIG. 1 is that the shaking table 11 of FIG. 1 is omitted, and instead the container 1 has an inclined bottom 30 which receives the powder 4. A plenum chamber 31 is arranged to supply gas under pressure to nozzles or openings 32 in the bottom 30 for the purpose of fluidizing the powder 4 and so encouraging it to flow along the channel formed by the sides of the container 1 and the bottom 30 to the outlet opening 14. The gas supply to the plenum chamber 31 may be taken from the compressor 22 (FIG. 1) via a pipe 33. In all other respects the apparatus of FIG. 2 is the same as that of FIG. 1.

What is claimed is:

1. Apparatus for manufacturing powder by a melt atomization process, said apparatus comprising a container, means for forming a stream of the melt in said container, means for directing a jet of gas transversely into the melt stream in order to atomize the melt stream into droplets which solidify in said container to form powder which falls onto a powder-receiving and transporting means in a lower part of said container for transporting the powder to an outlet for powder from the container, means for withdrawing gas from said container, means for cooling at least a part of the withdrawn gas, means for re-introducing at least part of the cooled gas into said lower part of the container, and guide means for forcing said re-introduced gas to flow in contact with the powder on said powder-receiving and transporting means in a direction substantially opposite to the direction of flow of the powder as it is transported to said outlet by said powder-receiving and transporting means.

2. Apparatus according to claim 1, wherein said powder-receiving and transporting means is provided by an inclined bottom of said container.

3. Apparatus according to claim 1, wherein said powder-receiving and transporting means is provided by a table and means for imparting a shaking movement to said table.

4. Apparatus according to claim 3, wherein said table is adapted to throw the powder upwardly therefrom.

5. Apparatus according to claim 2, wherein said bottom is channel-shaped.

6. Apparatus according to clam 5, wherein said bottom is formed with openings or nozzles for injecting gas in order to fluidize the powder on the bottom.

7. Apparatus according to claim 3 or claim 4, wherein said table is chaannel-shaped.

* * * * *